US007030355B1

(12) United States Patent
Bochenski et al.

(10) Patent No.: US 7,030,355 B1
(45) Date of Patent: Apr. 18, 2006

(54) LOW POWER PHOTOMULTIPLIER TUBE CIRCUIT AND METHOD THEREFOR

(75) Inventors: Edwin B. Bochenski, Tracy, CA (US); Jack L. Skinner, Brentwood, CA (US); Paul M. Dentinger, Sunol, CA (US); Scott C. Lindblom, Tracy, CA (US)

(73) Assignee: Sandia National Laboratories, Livermore, CA (US)

( * ) Notice: Subject to any disclaimer, the term of this patent is extended or adjusted under 35 U.S.C. 154(b) by 0 days.

(21) Appl. No.: 10/910,853

(22) Filed: Aug. 3, 2004

(51) Int. Cl.
*H01J 40/14* (2006.01)

(52) U.S. Cl. ..... 250/207; 250/214 VT; 250/214 SW

(58) Field of Classification Search ..... 250/207, 250/214 VT, 214 SW; 313/532, 533
See application file for complete search history.

(56) References Cited

U.S. PATENT DOCUMENTS

| | | | | |
|---|---|---|---|---|
| 2,576,661 | A | 11/1951 | Wouters | 250/207 |
| 2,594,703 | A | 4/1952 | Wouters | 250/207 |
| 2,867,729 | A | 1/1959 | Morton et al. | 250/207 |
| 2,951,941 | A | 9/1960 | Brannon, Jr. | 250/71.5 |
| 3,349,273 | A | 10/1967 | Gregg | 313/95 |
| 3,435,233 | A | 3/1969 | Fransworth | 250/207 |
| 3,777,201 | A | 12/1973 | Einstein | 313/65 R |
| 3,997,779 | A | 12/1976 | Rabi | 250/207 |
| 5,191,517 | A | 3/1993 | Stephenson | 363/59 |
| 5,493,111 | A | 2/1996 | Wheeler et al. | 250/207 |
| 5,523,556 | A | 6/1996 | Meddaugh et al. | 250/214 |
| 5,701,004 | A * | 12/1997 | Nakaya | 250/207 |
| 5,880,457 | A | 3/1999 | Tomiyama et al. | 250/207 |
| 6,841,936 | B1 * | 1/2005 | Keller et al. | 313/533 |

* cited by examiner

*Primary Examiner*—Stephone B. Allen
*Assistant Examiner*—Davienne Monbleau
(74) *Attorney, Agent, or Firm*—Timothy P. Evans

(57) ABSTRACT

An electrical circuit for a photomultiplier tube (PMT) is disclosed that reduces power consumption to a point where the PMT may be powered for extended periods with a battery. More specifically, the invention concerns a PMT circuit comprising a low leakage switch and a high voltage capacitor positioned between a resistive divider and each of the PMT dynodes, and a low power control scheme for recharging the capacitors.

14 Claims, 3 Drawing Sheets

*- Prior Art -*

LOW POWER PHOTOMULTIPLIER TUBE CIRCUIT AND METHOD THEREFOR

STATEMENT OF GOVERNMENT INTEREST

This invention was made with Government support under government contract DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

BACKGROUND OF THE INVENTION

1. Technical Field

Disclosed is an electrical circuit for a photomultiplier tube (PMT) that reduces power consumption. More specifically, the invention concerns a PMT circuit comprising a low leakage switch and capacitor positioned between the resistive divider and each of the PMT electron multiplying elements (dynodes), a low power control scheme for recharging the capacitors, and a low power scheme for delivering high voltage to the PMT.

2. Related Art

Photomultiplier tubes are well known in the art having been developed well over 50 years ago. Examples are shown in U.S. Pat. No. 2,867,729 and U.S. Pat. No. 3,435,233 (herein incorporated by reference). A typical PMT includes a photocathode at one end of the tube, a focusing electrode, a series of electron multiplying elements (dynodes), and an anode. The photocathode itself comprises a photoemissive material which ejects electrons in response to photons which hit the material. An associated power supply biases the focusing electrode and dynodes to accelerate the electrons away from the photoemissive material of the photocathode and axially through the tube. As each electron hits an attracting dynode, that electron causes the dynode to eject one or more electrons. These electrons, in turn, are attracted to and hit the next high biased dynode, which ejects still more electrons. The effect therefore is to create a cascade of electrons as they move down the ladder of dynodes effect. The cascade of electrons continues through the center of the tube toward the anode. The anode collects the electrons at the other end of the tube and produces a signal indicating the amount of light or other radiation to which the photoemissive material of the photocathode has been exposed.

Conventional PMT circuits, such as, the circuit diagrams shown in U.S. Pat. No. 2,867,729 and U.S. Pat. No. 2,576,661 typically positioned the PMT anode closest to ground potential and the photocathode at the highest negative voltage. A power supply produces a single high negative voltage that is then divided down for each dynode by a series of resistors. In this prior art case, the power supply comprises a voltage source and a voltage dividing bleeder string comprising a series of resistors connected to the dynodes within the PMT. Each resistor of the bleeder string is connected to bias an adjacent accelerator stage of the PMT. This scheme, however, requires that the power supply be on continuously to supply the current drain of the resistive divider.

Another biasing method shown and described in U.S. Pat. No. 5,523,556 comprises an alternating current source and a Cockcroft-Walton ("CW") Circuit. The CW Circuit comprises discrete elements such as diodes and capacitors, which are hard-wired in a ladder circuit. A first stage of the CW circuit multiplies the voltage of the voltage source.

Successive stages of the CW circuit multiply the voltage of each preceding stage; separate stages of the ladder comprising the CW Circuit are connected to successive dynodes of the PMT. This method can draw significantly less power than circuit comprising only the resistive divider; but the leakage in the diodes is still significant enough to require a continuously energized high voltage power supply.

Still other examples are shown in the art. U.S. Pat. No. 2,594,703 and U.S. Pat. No. 2,951,941 illustrate voltage divider circuits that employ capacitors between each of the several dynode stages to prevent fluctuations in the voltage supplied by the power supply. No mention, however, is made to suggest charging the capacitors followed by powering down the high voltage source assembly in order to save electrical energy. Lastly, U.S. Pat. No. 5,880,457 illustrates a voltage divider circuit that employs the use of switches at each dynode of a PMT. The stated intent of these switches is to provide an ability to change the electron multiplication factor of the PMT and not to reduce power consumption.

What is needed, therefore, is a circuit and method for reducing power consumption to the point where it is possible to power a PMT assembly for extended periods using only a battery or some other form of stored energy.

SUMMARY OF THE INVENTION

The high gain and rapid rise time (less than ins) of a photomultiplier tube (PMT) makes it the preferred method for detecting minute amounts of light. High gain and fast rise time, however, are purchased with high power consumption rendering many applications problematic where it would be useful to power the PMT using stored energy; that is, battery-powered applications. In particular, in cases of remote surveillance of an intermittent signal where the timing of the signal is known to be random, the PMT must be continuously powered. As noted, because of the high power demands of the PMT, battery powered systems are generally not feasible.

Therefore, a low power method for operating a PMT is demonstrated suitable for long life battery applications where the signal is intermittent and random. In particular, a biasing method is demonstrated that allows for shutting down the high voltage power supply while keeping the PMT fully biased, and a control scheme is shown to recharge the capacitors at desired intervals.

The present invention, therefore, concerns an apparatus comprising a means to power down the high voltage supply driving a photocathode and set of dynodes in a PMT while keeping the PMT fully biased, and a control scheme to restart the power supply at designed intervals.

The apparatus also comprises a plurality of low leakage switches for electrically isolating the dynodes, and a plurality of capacitors for maintaining an operative electrical bias on each dynode in the PMT.

The invention also concerns a method for detecting intermittent radiation. The method comprises the step of supplying a first voltage from a power supply to a voltage multiplying circuit attached to a photocathode and to each of a plurality of dynodes, wherein each successive dynode is biased at a successively higher differential voltage from said cathode, and where electrons emitted by the photocathode in response to intermittent radiation are multiplied by each of said successive dynodes in a cascading response.

The method also includes the step of connecting an energy storage element across the photocathode and the first dynode, a similar energy storage element across the second and third dynode, a similar energy storage element across each of any additional pairs of dynodes, and across the last dynode.

The method also includes the step connecting a relay between the high voltage power supply and the photocathode, between the high voltage power supply and each of the dynodes, and between the high voltage power supply and the low voltage input.

The method also includes the step of periodically closing all of the relays, biasing each of the energy storage elements with the power supply, and then opening all of the relays to remove the continuous current drain of the resistive divider while keeping the active elements of the PMT fully biased, thereby providing the PMT with sufficient energy to operate and indicate a response to detected radiation.

The method also includes the step of a relay between the high voltage circuitry and the low voltage source, i.e. a battery, to allow the high voltage source to be isolated from the low power source periodically.

The method also includes the step of a control scheme to automatically and periodically closing the appropriate relays, biasing each of the energy storage elements with the power supply, and then opening all of the relays to remove the continuous current drain of the resistive divider while keeping the active elements of the PMT fully biased, thereby providing the PMT with sufficient energy to operate and indicate a response to detected radiation.

The method also includes the step of providing a charge pump circuitry to step the voltage from about 3 V to 50 V to about 200 V to 5000 V.

The disclosed apparatus and method provides for a PMT circuit characterized by low power consumption, and remote and independent operation using a battery.

DETAILED DESCRIPTION OF THE PREFERRED EMBODIMENTS

Figure 1:
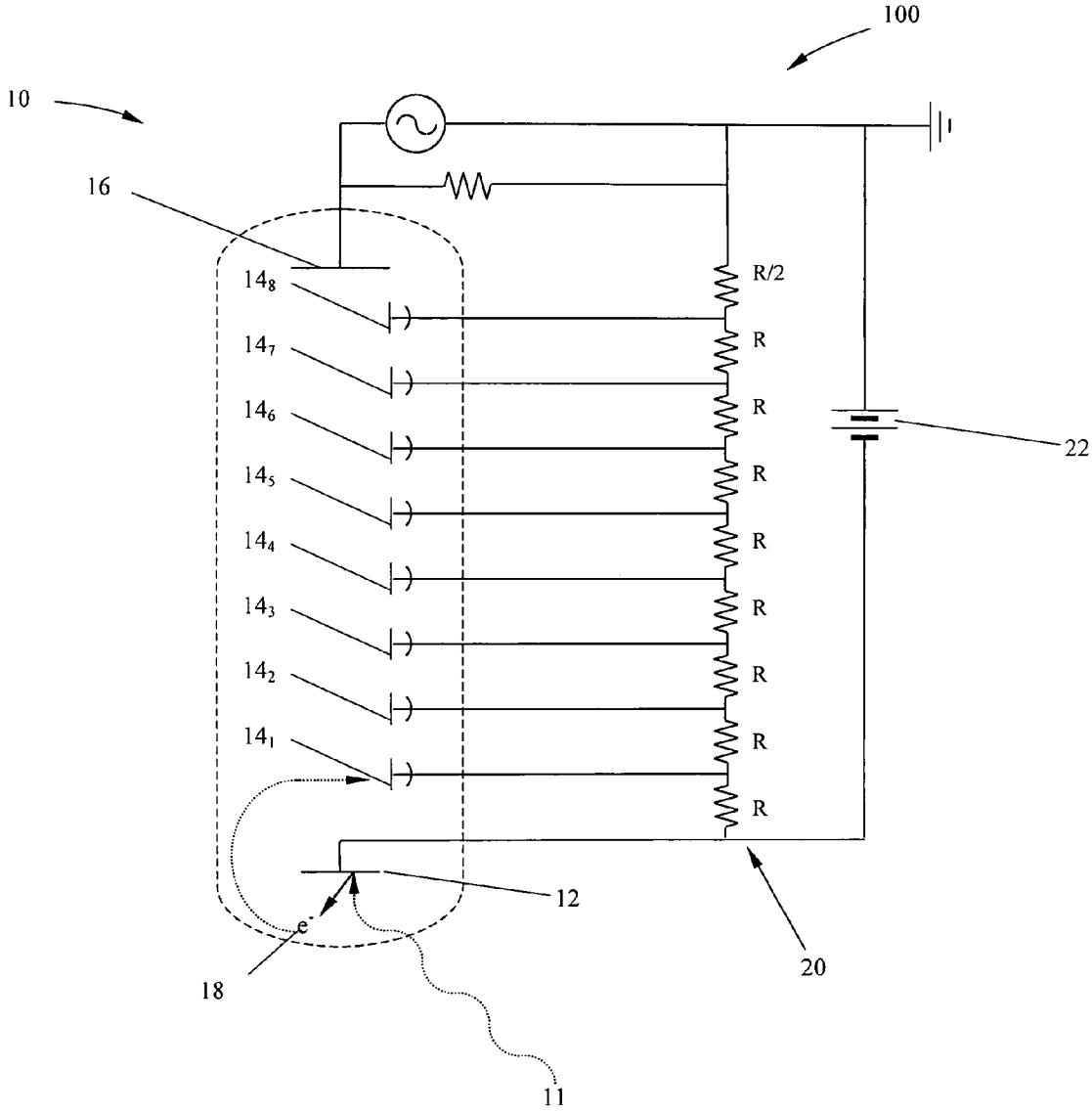
FIG. 1 illustrates a conventional circuit diagram used for a Photomultiplier Tube (PMT).

A conventional biasing circuit 100 for providing electrical energy to a PMT is shown in FIG. 1. The circuit includes a PMT 10 which itself includes a photocathode 12, one or more electron multiplying element (dynode) stages 14, and an anode 16, hereinafter collectively referred to as the PMT elements. PMTs are well known in the art and operate as follows. The photocathode has a photoemissive material (not shown) that ejects electrons in response to electromagnetic radiation 11, such as photons of light striking it. Ejected electrons 18 are then attracted toward a first dynode stage 14, by a voltage differential where (typically) several more electrons are ejected for every electron "falling" onto the dynode. This process of electron ejection and multiplication is generally repeated several more times through several additional dynode stages $\mathbf{14}_2$–$\mathbf{14}_8$, successively biased with an increasingly lower negative voltage moving toward anode 16, which is held at ground. Ejected electrons then pass from one dynode stage to the next in an avalanching effect toward the PMT anode where they are eventually collected by the anode to provide an electrical output signal proportional to the intensity/duration of radiation detected by PMT.

It is typical to apply a potential of between about −300 V to about −2000 V across a set of dynode stages in a "laddered" fashion. In most cases, this voltage is provided by a power supply 22 having a single high negative voltage that is divided down for each dynode stage $\mathbf{14}_1$–$\mathbf{14}_8$ by a voltage divider 20 comprised of a series of resistors. Other arrangements are possible. In particular, the photocathode may be biased with a high negative potential and the anode grounded as shown in FIG. 1, or the photocathode may be grounded and the anode biased at a high positive potential and each of the potential of each of the dynodes decremented in magnitude away from the anode. Moreover, while eight stages are shown any appropriate number of stages may be used.

However, in order for the PMT to remain active in the above example, circuit 100 must be powered continuously to supply the constant current drain of voltage divider 20. We have measured the power consumption of this PMT circuit configuration to be on the order of 1350 mW, well beyond what a small battery could support over any reasonably practical period. Larger resistors are possible in the resistive divider circuit, but eventually cause problems with electrical noise, and do not allow for powering down the high voltage supply. Moreover, even where diodes or transistors are used to block most of the leakage there is still a significant and continuous power drain over time that renders a battery-powered option impractical.

Figure 2:
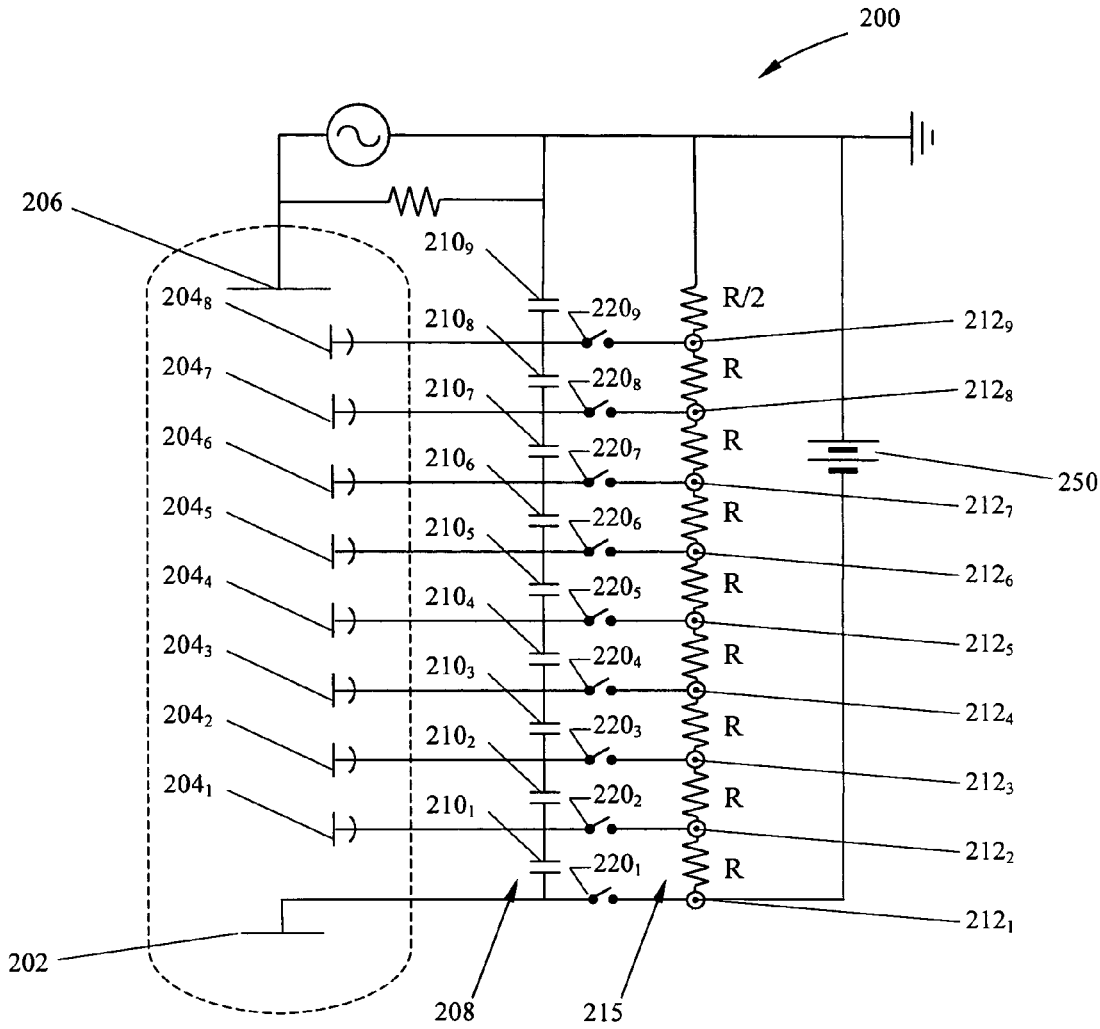
FIG. 2 illustrates the PMT circuit diagram of one embodiment of the present invention.

In order to overcome this obstacle we describe herein a very low leakage circuit and method for powering a PMT with a battery (typically a secondary battery, although a primary battery would function in those applications deemed to be non-recoverable). FIG. 2 illustrates a schematic of the electrical circuit 200 we have constructed and tested.

A novel aspect of circuit 200 is the manner in which each of the elements of the PMT is biased. In this embodiment we provide a number of high voltage capacitors $\mathbf{210}_1$–$\mathbf{210}_9$, connecting one capacitor between each of the PMT elements (cathode 202, dynodes $\mathbf{204}_1$–$\mathbf{204}_8$ and anode 206) to form a series network of capacitors 208. We then introduce low leakage switches $\mathbf{220}_1$–$\mathbf{220}_9$ into this circuit by attaching the input end of each switch 220 to the output end of each of the PMT elements (cathode 202, dynodes $\mathbf{204}_1$–$\mathbf{204}_8$ and anode 206) and connecting the output end from each of switch $\mathbf{220}_1$–$\mathbf{220}_9$ to each of the connection taps $\mathbf{212}_1$–$\mathbf{212}_9$ on a conventional voltage divider 215 comprised of resistors R and R/2. The end result of this arrangement is to provide a means for maintaining an operating voltage (capacitors $\mathbf{210}_1$–$\mathbf{210}_9$) on each of the PMT elements and a means for isolating (switches $\mathbf{220}_1$–$\mathbf{220}_9$) the PMT elements once the power supply has fully charged capacitors $\mathbf{210}_1$–$\mathbf{210}_9$ with an operating voltage.

Various capacitors were investigated for use as capacitors $\mathbf{210}_1$–$\mathbf{210}_9$, including 0.1 μF, 50 Vdc surface mount film capacitors (obtained from Cornell Dubilier Electric). This particular capacitor was chosen due to its small size; however, it is generally believed that the larger 0.1 μF 400 Vdc polypropylene ECQ-P (U) type capacitors (manufactured by Panasonic ECG) are the best mode.

"Switches" are herein defined as including "micro-switches," and particularly electro-mechanical solenoid relays. In principle, any switch capable of maintaining a circuit "stand-off" voltage of between about −300 V to about −2000 V, and having an "open" resistance of about $10^{10}$ ohms or greater at the required operating voltage is considered to fall within the scope of this disclosure. MEMS ("Micro-Electro-Mechanical Systems") switches based on electrostatic or electrothermal actuation are thought to be good choices, with the electrothermal switch expected to be particularly useful due to its low required drive voltage. However, electronic switches such as FETs and the like have been found to be unsuitable for use in the present embodiments due to their very high leakage rates, especially at higher voltages and elevated temperatures. The particular switch used herein was a standard 5 Vdc SD1A05DWJ electromechanical reed relay (obtained from Aleph International).

Finally, we found that the choice of resistors R and R/2 was found to be much less demanding. Generally, any resistor arrangement providing the desired voltage at each dynode was found to be acceptable. For the present PMT, an R7400U series tube (manufactured by Hamamatsu Photonics, K.K.), was used. The resistance ratio to provide the necessary voltage distribution for this tube between the cathode and the first dynode, and between each subsequent pair of dynodes was 1:1, while the resistance ratio between the last dynode and the PMT anode is half that of the prior pairs. The parts used herein were 330 kΩ and 160 kΩ metal film, 1 W resistors (obtained from BC Components).

Circuit 200, therefore, provides a series network of capacitors for maintaining a potential on each of the PMT elements in parallel with a standard voltage divider acting to provide the "laddered" voltage potential necessary for PMT operation, where each pair of capacitors and resistors is separated by a low-leakage switch for isolating the capacitors once each is charged. The effect of this is to isolate the PMT from the power supply but maintain a constant operating bias on each of the PMT functional elements so that the PMT is able to produce an output in response to light detection without the constant power drain of conventional designs.

Voltage is applied to the circuit by connecting the (negative) high voltage end of our power source, in this case to battery 250 whose voltage is "stepped-up" with a high voltage power converter or through the use of a "voltage pump" circuit. High voltage thus provided is then directed to the front end (tap $\mathbf{212}_1$) of voltage divider 215 attached to cathode 202, and grounding the terminal end (tap $\mathbf{212}_9$) of divider 215 attached to anode 206.

In this embodiment, a battery is used as the power source although other types of stored energy such as super capacitors or fuel cells, would function as well and are, therefore, considered to fall within the scope of this disclosure. At a minimum, one or more lithium "D" cells, each providing a nominal 3.3 volts output, are necessary. However, due to the power draw at the dc—dc voltage converter, two or more parallel strings of these cells are desirable to avoid overly polarizing any one cell in the battery during use. The voltage converter used herein was a C4900 series "on-board" type power supply available from Hamamatsu Photonics, K.K., and operates at a nominal input voltage of +15 Vdc. Other voltage converters are of course possible which may require more or fewer cells, or as few as one cell, to supply the necessary input voltage.

The new circuit functions as follows. As switches $\mathbf{220}_1$–$\mathbf{220}_9$ are "closed", generally in tandem, power supply 250 charges each of capacitors $\mathbf{210}_1$–$\mathbf{210}_9$. Once the capacitors are charged, switches $\mathbf{220}_1$–$\mathbf{220}_9$ are again "opened" to separate high voltage power supply 250 and voltage divider 215 from each of the PMT elements. However, cathode 202 and dynode stages $\mathbf{204}_1$–$\mathbf{204}_8$, are now biased by the voltage potential stored by each capacitor $\mathbf{210}_1$–$\mathbf{210}_9$. Moreover, these PMT elements remain biased as long as capacitors $\mathbf{210}_1$–$\mathbf{210}_9$ remain charged.

However, even the circuit of the present embodiment consumes some power, principally due to leakage by the PMT itself: the so-called PMT "dark" current which amounts to about 0.1 nA at room temperature can rise to 1 nA at 50° C. –70° C. depending on the photocathode material used. The effect of this power drain on the present circuit is manifested as a slow loss of charge on each of capacitor $\mathbf{210}_1$–$\mathbf{210}_9$, the effect of which is shown graphically in FIG. 3. In order to address this issue, switches 220 must be closed periodically in order to recharge capacitors $\mathbf{210}_1$–$\mathbf{210}_9$.

Any of several methods can be used to set the period with which the capacitors are "re-charged". A timing circuit (not shown) can be programmed to close each of switches $\mathbf{220}_1$–$\mathbf{220}_9$ well before the capacitors' charge falls below a point where the PMT is inoperative. In addition, switches $\mathbf{220}_1$–$\mathbf{220}_9$ may be closed in response to a "low voltage" sensing circuit (not shown) used to detect any decrease in capacitance charge below about 90% capacity in the potential of the stack of capacitors. Either method can include a temperature sensing means such as a thermistor, which would increase or decrease the rate or recharge based on the ambient temperature.

Capacitors $\mathbf{210}_1$–$\mathbf{210}_9$, therefore, are used to maintain an operating voltage potential on each of dynode stages $\mathbf{204}_1$–$\mathbf{204}_8$ while electrically disconnected from power supply 250. Note that although only eight dynode stages are shown in the drawings the number of stages is dictated by the particular PMT used. More or fewer stages, therefore, are possible.

Figure 3:
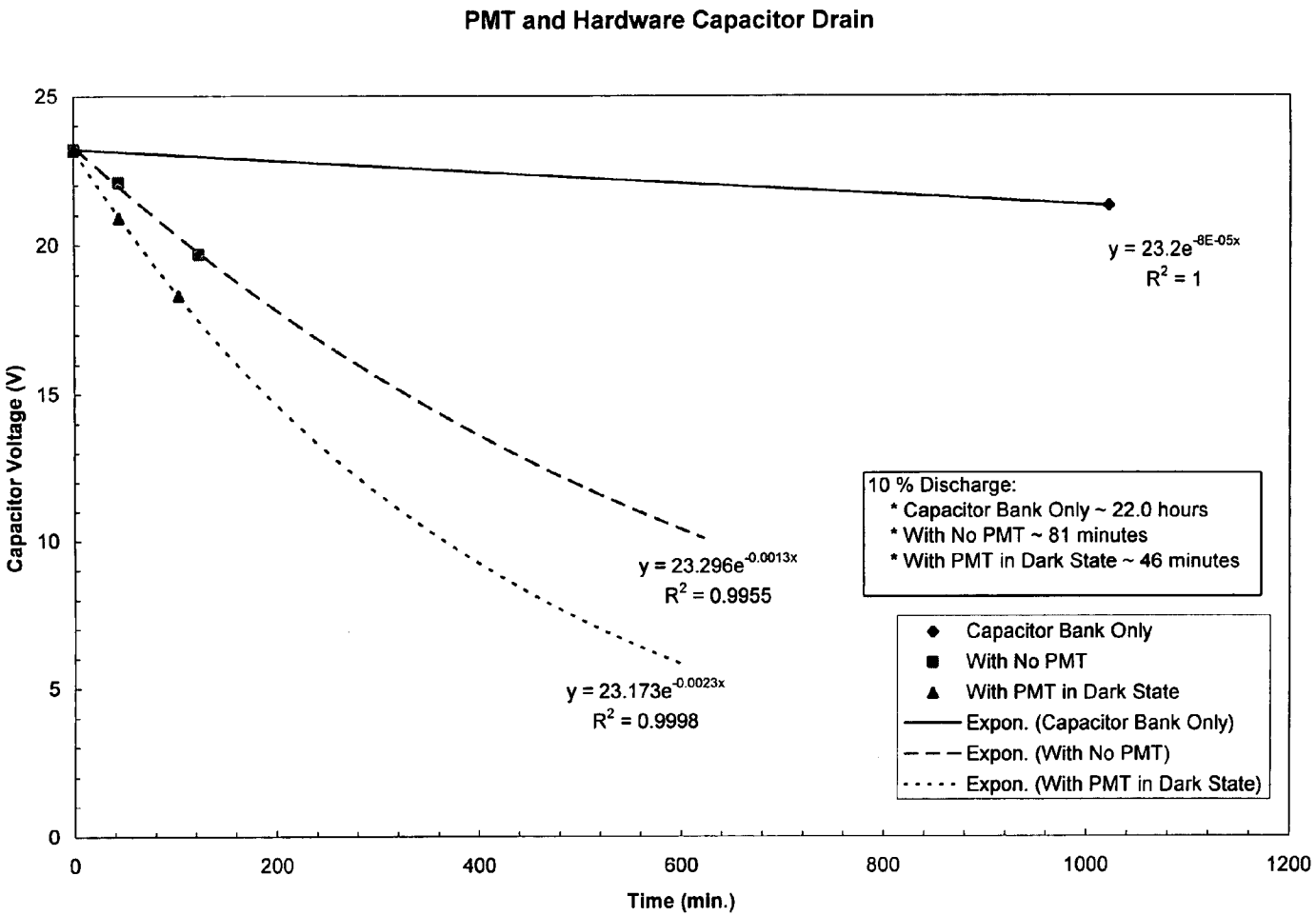
FIG. 3 shows a graphic display of the measured and predicted PMT and capacitor drain over time for three different circuit arrangements.

The test results, shown below in TABLE 1 and graphically in FIG. 3. FIG. 3 shows the amount of current leakage measured for three different configurations: 1) the capacitors and switch bank; 2) capacitors, switch bank, and PMT board with no PMT inserted; 3) the complete circuit with a PMT inserted. Case 2 with the PMT board and no PMT indicates that the PMT circuitry is causing significant leakage. This is a common problem in low power circuits and is most likely due to poor layout and cleaning of the PMT board. Case 3 with the PMT installed indicates that if the leakage of the circuitry is solved by good industrial practice, the PMT itself is a larger contributor to the overall power consumption than the rest of the circuit.

These results suggest that in this configuration the PMT becomes the dominating factor in determining leakage. This leakage current drains the capacitors to 90% of capacity over periods of up to about 45 minutes when the PMT is in a "dark" state causing the voltage impressed on the dynodes to drop. When the minimum allowed voltage is reached, switches $\mathbf{220}_1$–$\mathbf{220}_9$ are again closed briefly, thereby connecting power supply 250 to capacitors $\mathbf{210}_1$–$\mathbf{210}_9$. Capacitors $\mathbf{210}_1$–$\mathbf{210}_9$ can be selected to optimize the tradeoffs between size, time between charging, and current capacity. The current capacity is important as it determines how long the PMT will be able to produce an output before draining the capacitors of charge.

TABLE 1

Measured performance of the present circuit embodiment in three separate configurations

| Circuit with Capacitors only | | | Circuit without PMT | | | Circuit with PMT in Dark State | | |
|---|---|---|---|---|---|---|---|---|
| Time (min.) | Voltage (V) | \|Voltage\| \|V\| | Time (min.) | Voltage (V) | \|Voltage\| \|V\| | Time (min.) | Voltage (V) | \|Voltage\| \|V\| |
| 0 | −23.2 | 23.2 | 0 | −23.2 | 23.2 | 0 | −23.2 | 23.2 |
| 1022 | −21.3 | 21.3 | 44 | −22.1 | 22.1 | 44 | −20.9 | 20.9 |
| | | | 123 | −19.7 | 19.7 | 103 | −18.3 | 18.3 |

The control scheme for such a circuit needs to be considered carefully in order to avoid increasing the power consumption. The simplest scheme is to periodically turn the power supply on, close the switches, and recharge the capacitors for a predetermined amount of time. Then the switches are opened, and the power supply is turned off. This scheme will work well if the power consumption has been precisely characterized, and the circuit operates in a temperature-controlled area since leakage currents will increase with temperature. More complex control methods could use a temperature monitor to determine how often to recharge the capacitors or could monitor the voltage across one of the capacitors.

We have demonstrated a method of operating a photomultiplier tube circuit that results in minimal operating power. This method is particularly suited to battery operation where the photomultiplier must be continuously active but where the constant drain of a conventional circuit would quickly consume the stored energy of any reasonably portable battery. The present embodiment therefore provides the capability for remote and unattended PMT operation where the ready availability of electrical energy is greatly limited or not present at all.

Finally, those having skill in these arts will appreciate that while only a PMT is recited throughout the foregoing description, nothing would limit using the circuit with other devices or in other applications. In particular, devices closely related to PMTs are electro-optical devices based on the so-called microchannel plate technology such as described in U.S. Pat. No. 3,742,224 and U.S. Pat. No. 5,493,111. A device such as this may be substituted for the PMT in the present circuit, wherein each of the microchannel plates of the electro-optical device would directly substitute for a corresponding PMT dynode. Such a configuration therefore is held to fall within the teaching of this disclosure.

What is claimed is:

1. A low power consuming circuit, comprising:

a photomultiplier comprising a cathode, an anode, and n electron multiplying elements disposed therebetween, wherein n is an integer increasing from 1;

biasing means for biasing said cathode and said n electron multiplying elements with an operating voltage;

means for electrically disconnecting said cathode and each of said n electron multiplying elements from said biasing means; and means for maintaining said operating voltage on said cathode and said n electron multiplying elements while said cathode and said n electron multiplying elements are electrically disconnected from said biasing means.

2. The device of claim 1, wherein the biasing means comprises a source of stored electrical energy applied across first and second ends of a resistive voltage divider comprising a plurality of n+1 sequential voltage taps, wherein each of said sequential voltage taps is separately connected in electrical communication to one of said means for electrically disconnecting, and wherein a first of said means for electrically disconnecting is separately connected in electrical communication with said cathode, and wherein each of a remaining n means for electrically disconnecting is separately and sequentially connected in electrical communication with one of said n electron multiplying elements.

3. The device of claim 2, wherein said anode is maintained at a ground potential and said cathode is maintained at a more negative electric potential relative to each of said n electron multiplying elements, and wherein each of said n electron multiplying elements is maintained in a sequential order of electric potentials.

4. The device of claim 2, wherein the source of stored electrical energy is selected from the group consisting of one or more electrochemical cells, a super-capacitor, a fuel cell, and combinations thereof.

5. The device of claim 2, wherein the source of stored electrical energy comprises one or more series-parallel strings of electrochemical cells.

6. The device of claim 2, wherein the means for electrically disconnecting comprises n+1 low leakage switches.

7. The device of claim 6, wherein the means for maintaining said operating voltage comprises a plurality of n+1 capacitors electrically connected in series, wherein a first one of said capacitors is additionally electrically connected in series between said cathode and a first electron multiplying elements, i, immediately adjacent to said cathode, where i an integer increasing from 1 to n, wherein each of a second through an $n^{th}$ capacitor is separately connected in series between succeeding sequential pairs of said electron multiplying elements beginning with said first electron multiplying element, i, and said next adjacent electron multiplying element, i+1, and where i is incremented by 1 for each succeeding pair, wherein an $n^{th}+1$ capacitor is electrically connected in series between said anode and the $n^{th}$ electron multiplying element.

8. The device of claim 7, further comprising means for periodically electrically reconnecting said cathode, and each of said n electron multiplying elements with said biasing means.

9. The device of claim 8, wherein said means for periodically electrically reconnecting comprises means for sensing a decline in capacitor charge below a predetermined level.

10. The device of claim 8, wherein said means for periodically electrically reconnecting comprises means for operating said n+1 low leakage switches in tandem.

11. The device of claim 10, wherein said means for periodically electrically reconnecting comprises electrically reconnecting said low leakage switches at the expiration of a fixed period of time.

12. The device of claim 11, wherein said means for periodically electrically reconnecting further comprises ambient temperature sensing means operating to modify said fixed period commensurate with a change in said ambient temperature.

13. A method for providing a low power consuming photomultiplier tube (PMT) circuit, comprising the steps of:

electrically connecting each of a PMT cathode and one or more PMT dynodes with a separate one of a plurality of energy storage means, wherein each of said PMT cathode and said one or more PMT dynodes is biased with an operating voltage;

charging each of said plurality of energy storage means with an electric potential; and electrically disconnecting each of said PMT cathode and said one or more PMT dynodes from said separate energy storage means.

14. A method for providing a low power consuming photomultiplier tube (PMT) circuit, comprising the steps of:

providing a plurality of energy storage means, wherein each energy storage means is electrically connected separately to one of a PMT cathode or one or more PMT dynodes;

biasing each of said separate energy storage means with an electric potential, wherein said PMT cathode, and each of said one or more PMT dynodes is biased with an operating voltage; and electrically disconnecting each of said PMT cathode and said one or more PMT dynodes from said separate energy storage means.

* * * * *